US010939796B2

(12) United States Patent
Kopera et al.

(10) Patent No.: US 10,939,796 B2
(45) Date of Patent: Mar. 9, 2021

(54) DISHWASHER APPLIANCE WITH ADJUSTABLE DRY CYCLE

(71) Applicant: Haier US Appliance Solutions, Inc., Wilmington, DE (US)

(72) Inventors: Timothy Kopera, Louisville, KY (US); Adam Christopher Hofmann, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 79 days.

(21) Appl. No.: 15/967,666

(22) Filed: May 1, 2018

(65) Prior Publication Data

US 2019/0335974 A1 Nov. 7, 2019

(51) Int. Cl.

| | |
|---|---|
| ***A47L 15/00*** | (2006.01) |
| ***A47L 15/42*** | (2006.01) |
| ***A47L 15/48*** | (2006.01) |
| ***A47L 15/46*** | (2006.01) |

(52) U.S. Cl.

CPC ..... *A47L 15/4251* (2013.01); *A47L 15/4278* (2013.01); *A47L 15/4287* (2013.01); *A47L 15/46* (2013.01); *A47L 15/486* (2013.01)

(58) Field of Classification Search

CPC ..... A47L 15/0013; A47L 15/0034; A47L 15/4251; A47L 15/4278; A47L 15/4287; A47L 15/46; A47L 15/48; A47L 15/486; A47L 15/488; A47L 2401/04; A47L 2401/12; A47L 2401/18; A47L 2401/20; A47L 2401/22; A47L 2401/34; A47L 2501/10; A47L 2501/11; A47L 2501/12; A47L 2501/30; A47L 2501/34

See application file for complete search history.

(56) References Cited

U.S. PATENT DOCUMENTS

| | | | | |
|---|---|---|---|---|
| 5,446,531 | A * | 8/1995 | Boyer | A47L 15/4287 134/113 |
| 5,560,060 | A * | 10/1996 | Dausch | A47L 15/0044 8/158 |
| 6,694,990 | B2 | 2/2004 | Spanyer et al. | |
| 2006/0023556 | A1 | 2/2006 | Versen et al. | |
| 2011/0126864 | A1* | 6/2011 | Kim | A47L 15/486 134/25.2 |
| 2012/0145200 | A1* | 6/2012 | Jerg | A47L 15/0015 134/25.2 |

FOREIGN PATENT DOCUMENTS

| | | | | |
|---|---|---|---|---|
| CA | 2171805 C | * | 8/2000 | A47L 15/0034 |
| CA | 2394947 C | | 1/2010 | |
| WO | WO2009074418 A1 | | 6/2009 | |
| WO | WO2013014871 A1 | | 1/2013 | |

* cited by examiner

*Primary Examiner* — David G Cormier

(74) *Attorney, Agent, or Firm* — Dority & Manning, P.A.

(57) ABSTRACT

A dishwasher appliance that includes features for condensation abatement on objects surrounding the dishwasher appliance during a drying cycle is provided. The dishwasher appliance is operable in a plurality of drying cycle modes. The mode in which the dishwasher appliance operates the dry cycle is determined based at least in part on a minimum cycle temperature indicative of the minimum temperature within or of a tub of the dishwasher appliance during an operation cycle. Moreover, methods for condensation abatement are also provided.

16 Claims, 5 Drawing Sheets

DISHWASHER APPLIANCE WITH ADJUSTABLE DRY CYCLE

FIELD OF THE INVENTION

The present disclosure relates generally to dishwasher appliances, and more particularly to dishwasher appliances having an adjustable dry cycle.

BACKGROUND OF THE INVENTION

Dishwasher appliances generally include a tub that defines a wash chamber. Rack assemblies can be mounted within the wash chamber of the tub for receipt of articles for washing. Multiple spray assemblies can be positioned within the wash chamber for applying or directing wash fluid towards articles disposed within the rack assemblies in order to clean such articles. Dishwasher appliances are also typically equipped with at least one circulation pump for circulating fluid through the multiple spray assemblies.

During an operation cycle of a dishwasher appliance, the dishwasher appliance may perform a wash cycle to wash the articles, a rinse cycle to rinse the wash fluid from the articles, a drain cycle to drain the wash fluid from the tub, and a drying cycle to dry the articles. During a drying cycle, the articles may be dried by a forced air convection system that exhausts the relatively hot and moist air from the tub. Heating elements may also be used to facilitate drying. In some instances, particularly during colder months, the relatively hot and moist air exhausted from the tub settles or pools on the floor proximate the dishwasher appliance. Such condensation build up is inconvenient, potentially unsafe, and is generally undesirable. Accordingly, to abate floor condensation, the forced air convection systems of some dishwashers include features that add relatively cool and dry air to the relatively hot and moist exhaust stream. Although adding the relatively cool and dry airstream to the relatively hot and moist airstream lowers the dew point of the exhaust stream and thus abates floor condensation, efficiencies are lost as the dry/moist air mixture of the exhaust stream is typically set to account for nearly all use cases. Efficiencies are particularly affected in warmer months.

Accordingly, a dishwasher appliance and methods of operation therefore that address one or more of the challenges noted above would be useful.

BRIEF DESCRIPTION OF THE INVENTION

Aspects and advantages of the invention will be set forth in part in the following description, may be apparent from the description, or may be learned through practice of the invention.

In accordance with one exemplary embodiment, a dishwasher appliance configured to perform an operation cycle is provided. The dishwasher appliance includes a cabinet and a tub positioned within the cabinet and defining a wash chamber for receipt of articles for washing. The dishwasher appliance also includes a temperature sensing device for sensing a minimum cycle temperature indicative of a minimum temperature within or of the tub during the operation cycle. Further, the dishwasher appliance includes a controller communicatively coupled with the temperature sensing device, the controller configured to: receive a temperature signal from the temperature sensing device; operate the dishwasher appliance in a wash cycle; determine whether the minimum cycle temperature exceeds one or more temperature thresholds; determine a dry cycle mode based at least in part on whether the minimum cycle temperature exceeds the temperature threshold; and operate the dishwasher appliance in a dry cycle in the dry cycle mode determined.

In accordance with another exemplary embodiment, a method for operating a dishwasher appliance in an operation cycle is provided. The method includes receiving a temperature signal indicative of a minimum cycle temperature, the minimum cycle temperature indicative of a minimum temperature within a tub of the dishwasher appliance during the operation cycle; determining whether the minimum cycle temperature exceeds a temperature threshold; determining a dry cycle mode based at least in part on whether the minimum cycle temperature exceeds the temperature threshold; and operating the dishwasher appliance in a dry cycle in the dry cycle mode determined.

In accordance with yet another exemplary embodiment, a method for operating a dishwasher appliance is provided. The method includes commencing a current operation cycle; determining whether the dishwasher appliance has operated a previous operation cycle within a predetermined time of commencing the current operation cycle; receiving a signal indicative of a minimum cycle temperature; determining whether the minimum cycle temperature exceeds one or more temperature thresholds; determining a dry cycle mode based at least in part on whether the minimum cycle temperature exceeds the one or more temperature thresholds; and operating the dishwasher appliance in a dry cycle in the dry cycle mode determined.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
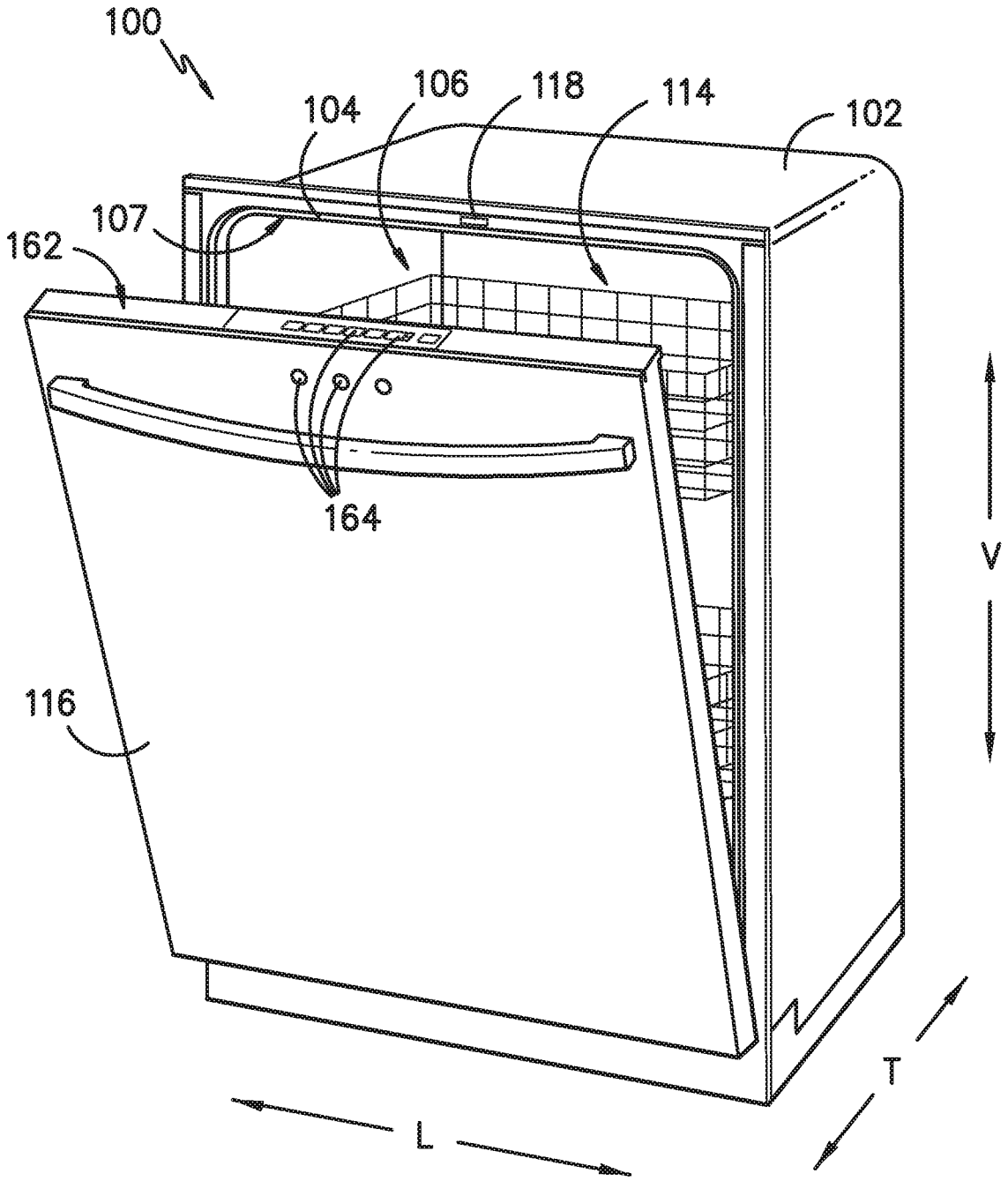
FIG. 1 provides a perspective view of an exemplary dishwasher appliance according to an exemplary embodiment of the present disclosure with a door of the dishwasher appliance in an open position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent (10%) margin of error.

Figure 2:
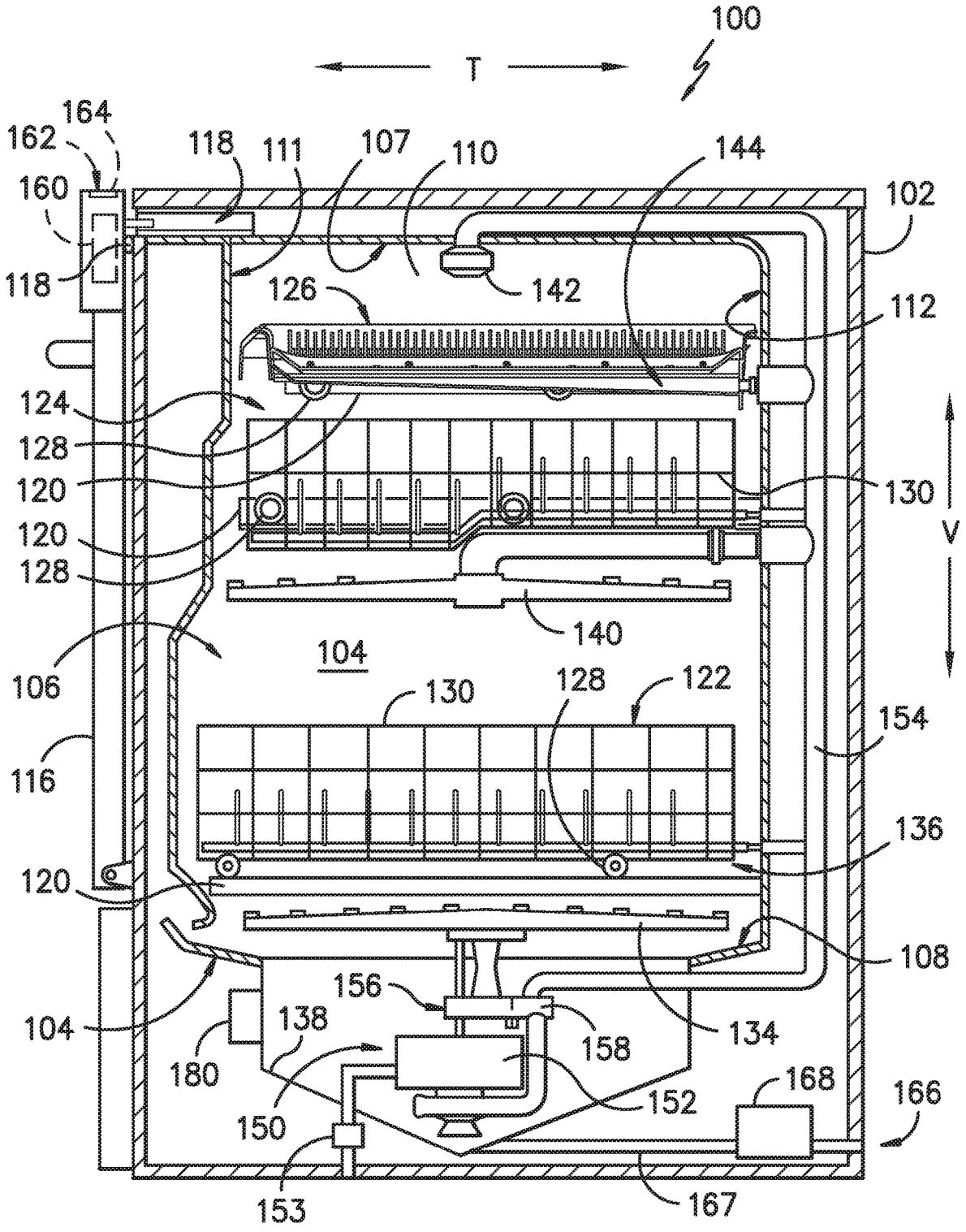
FIG. 2 provides a side, cross sectional view of the exemplary dishwasher appliance of FIG. 1.

FIGS. 1 and 2 depict an exemplary dishwashing or dishwasher appliance 100 that may be configured in accordance with aspects of the present disclosure. For the particular embodiment of FIGS. 1 and 2, dishwasher 100 defines a vertical direction V, a lateral direction L, and a transverse direction T. Each of the vertical direction V, lateral direction L, and transverse direction T are mutually perpendicular to one another and form an orthogonal direction system. Dishwasher 100 includes a cabinet 102 having a tub 104 therein that defines a wash chamber 106. As shown in FIG. 2, tub 104 extends between a top 107 and a bottom 108 along the vertical direction V, between a pair of sidewalls 110 along the lateral direction L, and between a front side 111 and a rear side 112 along the transverse direction T.

Tub 104 includes a front opening 114 (FIG. 1) and a door 116 rotatably coupled with cabinet 102 and hinged at its bottom for movement between a normally closed vertical position (shown in FIG. 2), wherein the wash chamber 106 is sealed shut for washing operation, and an open position for loading and unloading of articles from the dishwasher 100 (FIG. 1). Dishwasher 100 includes a door closure mechanism or assembly 118 that is used to lock and unlock door 116 for accessing and sealing wash chamber 106.

As further shown in FIG. 2, tub sidewalls 110 accommodate a plurality of rack assemblies. More specifically, guide rails 120 are mounted to sidewalls 110 for supporting a lower rack assembly 122, a middle rack assembly 124, and an upper rack assembly 126. Upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to other exemplary embodiments, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 is generally configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

The various spray assemblies and manifolds described herein may be part of a fluid distribution system or fluid circulation assembly 150 for circulating water and wash fluid in tub 104. More specifically, fluid circulation assembly 150 includes a circulation pump 152 for circulating water and wash fluid (e.g., detergent, water, and/or rinse aid) in tub 104. Circulation pump 152 is located within sump 138 or within a machinery compartment located below sump 138 of tub 104. Sump 138 is in fluid communication with tub 104. Circulation pump 152 is in fluid communication with an external water supply line (not shown) and sump 138. A water inlet valve 153 can be positioned between the external water supply line and circulation pump 152 to selectively allow water to flow from the external water supply line to circulation pump 152. Additionally or alternatively, water inlet valve 153 can be positioned between the external water supply line and sump 138 to selectively allow water to flow from the external water supply line to sump 138. Water inlet valve 153 can be selectively controlled to open to allow the flow of water into dishwasher 100 and can be selectively controlled to cease the flow of water into dishwasher 100.

Further, fluid circulation assembly 150 may include one or more fluid conduits or circulation piping for directing water and/or wash fluid from circulation pump 152 to the various spray assemblies and manifolds. For example, for the embodiment depicted in FIG. 2, a primary supply conduit 154 extends from circulation pump 152, along rear 112 of tub 104 along the vertical direction V to supply wash fluid throughout wash chamber 106.

As further illustrated in FIG. 2, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from circulation pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc.

In operation, circulation pump 152 moves wash fluid from sump 138 and pumps it to a diverter 156, e.g., which is positioned within sump 138 of dishwasher appliance. Diverter 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter 156 is configured for selectively distributing the flow of wash fluid from circulation pump 152 to various fluid supply conduits, only some of which are illustrated in FIG. 2 for clarity. More specifically, diverter 156 may include four outlet ports (not shown) for supplying wash fluid to a first conduit for rotating lower spray arm assembly 134 in the clockwise direction, a second conduit for rotating lower spray arm assembly 134 in the counter-clockwise direction, a third conduit for spraying an auxiliary rack such as the silverware rack, and a fourth conduit for supply mid-level and/or upper spray assemblies 140, 142, e.g., such as primary supply conduit 154.

Drainage of soiled water within sump 138 may occur, for example, through drain assembly 166. In particular, water may exit sump through a drain and may flow through a drain conduit 167. A drain pump 168 may facilitate drainage of the soiled water by pumping the water to a drain line external to the dishwasher 100.

Dishwasher 100 is further equipped with a controller 160 to regulate operation of dishwasher 100. Controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 160 may be positioned in a variety of locations throughout dishwasher 100. In the illustrated embodiment, controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

As further depicted in FIG. 2, dishwasher appliance 100 includes a temperature sensing device, which in this exemplary embodiment is thermistor 180. Thermistor 180 may be a component of a turbidity sensing mechanism, for example. Thermistor 180 is configured for sensing the temperature of the water or wash fluid circulating through dishwasher appliance 100, e.g., during a wash or rinse cycle. Further, in accordance with exemplary embodiments of the present disclosure, thermistor 180 is configured to sense the temperature within dishwasher appliance 100 at the start of an operation cycle of dishwasher appliance 100. More particularly, thermistor 180 is configured to sense the air temperature within dishwasher appliance 100 prior to any water or wash fluid entering tub 104. Thermistor 180 is communicatively coupled with controller 160, e.g., so that controller 160 may make decisions based at least in part on one or more outputs (e.g., temperature signals) generated by thermistor 180. For instance, controller 160 may receive one or more temperature signals indicative of the temperature within dishwasher appliance 100, and based at least in part on the temperature signals, controller 160 can determine an optimal drying mode for the dry cycle, as will be explained in greater detail herein.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
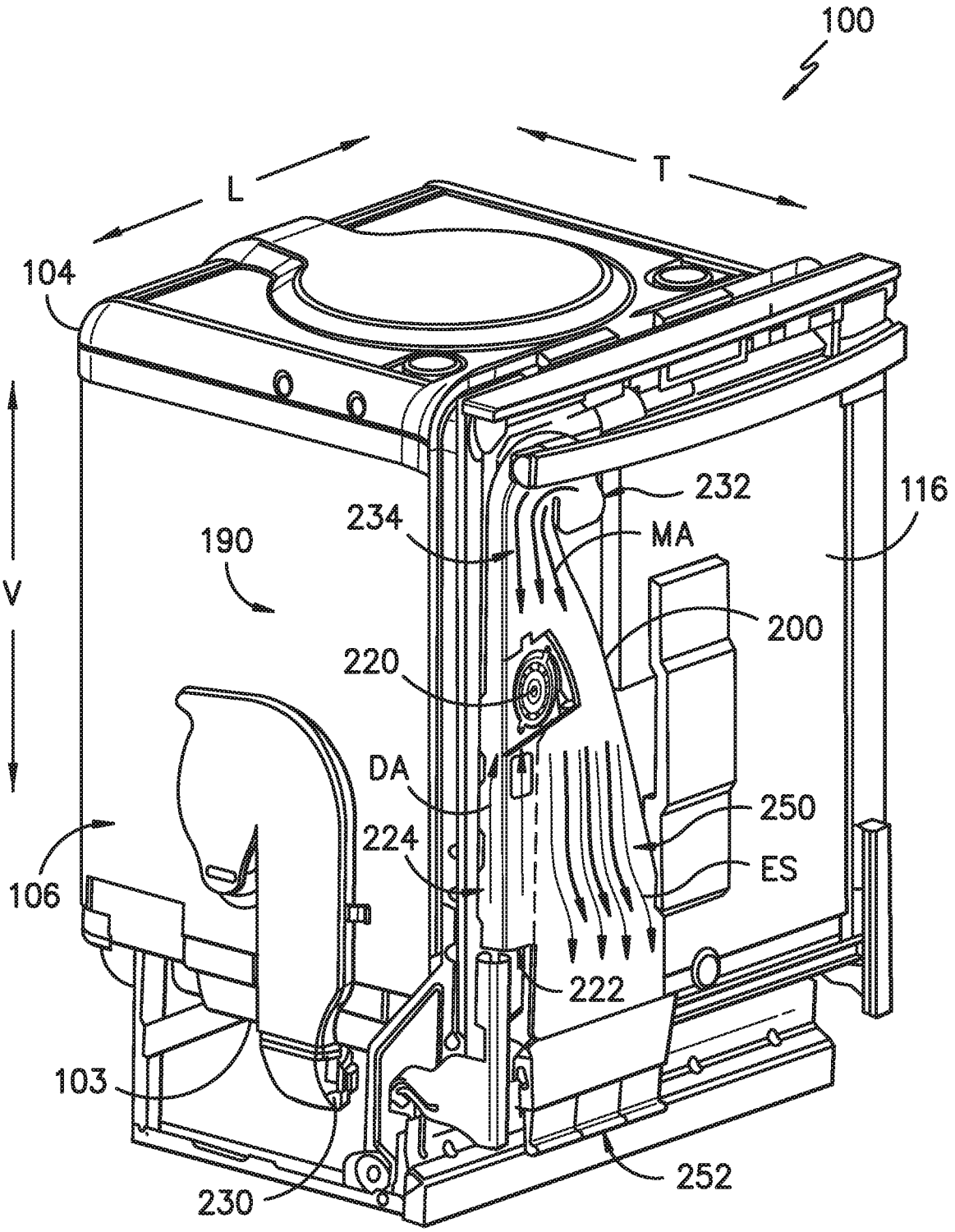
FIG. 3 provides a perspective view of the dishwasher appliance of FIG. 1 depicting a forced air drying system of the dishwasher appliance.

FIG. 3 provides a perspective view of the dishwasher appliance 100 of FIGS. 1 and 2 and depicts a forced air drying system 190 of dishwasher appliance 100. As shown, forced air drying system 190 includes a vent duct 200. Vent duct 200 is positioned within door 116. More particularly, vent duct 200 extends generally along the vertical direction V within door 116. Forced air drying system 190 of dishwasher appliance 100 also includes a tub fan, denoted as first fan 230, and an ambient fan, denoted as second fan 220.

First fan 230 is operable to flow air from wash chamber 106 into vent duct 200. In particular, first fan 230 may move ambient air from below tub 104 into wash chamber 106 thereby pressuring wash chamber 106 relative to the ambient air about dishwasher appliance 100. The pressurized air and water vapor within wash chamber 106 exits wash chamber 106 and flows into a first inlet 232 of vent duct 200. As shown in FIG. 3, first fan 230 moves relatively hot and moist air, denoted as moist airstream MA, from tub 104 into vent duct 200. Once the moist airstream MA flows through first inlet 232, the moist airstream MA flows through a first channel 234 of vent duct 200. For this embodiment, first fan 230 is mounted to tub 104 at a wall 103 of tub 104. Wall 103 of tub 104 may be a bottom wall as shown in FIG. 3. In alternative example embodiments, first fan 230 may be mounted to any other suitable wall of tub 104, such as one of the sidewalls 110 of tub 104. Further, in some embodiments, first inlet 232 of vent duct 200 may be defined by vent duct 200 on a side of dishwasher appliance 100 instead of being defined within door 116. Further, in some embodiments, first fan 230 may be mounted within door 116.

Second fan 220 is mounted to vent duct 200 within door 116 and is operable to flow ambient air from about dishwasher appliance 100 into vent duct 200. As shown, second fan 220 moves relatively cool and dry air, denoted as dry airstream DA, into a second inlet 222 of vent duct 200. Once the dry airstream DA flows through second inlet 222, the dry airstream DA flows through a second channel 224 of vent duct 200. In some alternative embodiments, second fan 220 may be mounted on the side of tub 104 or underneath dishwasher appliance 100.

When dishwasher appliance 100 is operated in a drying cycle, the moist airstream MA may mix with the dry airstream DA in a mixing channel 250 of vent duct 200 and may be exhausted through an outlet 252 defined by vent duct 200. More particularly, during operation in a dry cycle, first fan 230 moves moist airstream MA from wash chamber 106 of tub 104 into or through first inlet 232 of vent duct 200. In some instances, second fan 220 moves dry airstream DA into vent duct 200, e.g., to lower the temperature and dew point of an exhaust airstream ES, which is a mixture of the moist airstream MA and the dry airstream DA. Thus, in such cases, depending on the relative amounts of moist and dry air within the exhaust stream ES, the exhaust stream ES has a moist/dry air mixture. As will be explained further below, in embodiments where dishwasher appliance 100 includes forced air drying system, the drying cycle, and more particularly the moist/dry air mixture may be adjusted based at least in part on the temperature reading within tub 104 at the start of an operation cycle. In this way, optimal drying performance may be achieved while preventing condensation on a consumer's floor (or other surrounding objects) proximate dishwasher appliance 100.

Although outlet 252 is shown defined by vent duct 200 at a bottom portion of door 116 in FIG. 3, it will be appreciated that outlet 252 may be defined by vent duct 200 in other suitable locations, such as e.g., at a side of dishwasher appliance 100. Indeed, forced air drying system 190 may be entirely configured at one of the sides of dishwasher appliance 100 instead of being configured in part within door 116.

Figure 4:
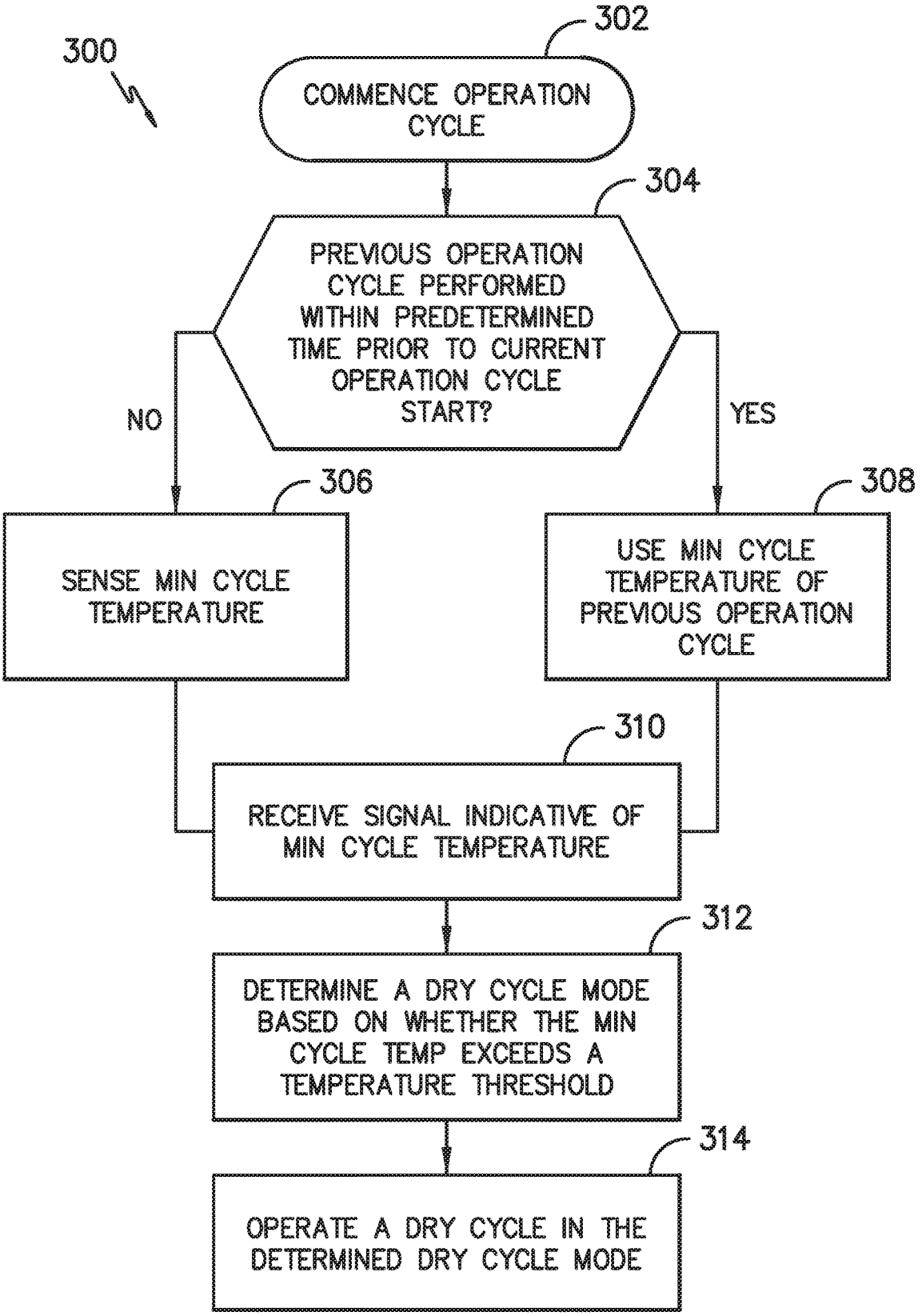
FIG. 4 provides a flow diagram of an exemplary method for adjusting a dry cycle of a dishwasher appliance according to exemplary embodiments of the present disclosure.

FIG. 4 provides a flow diagram of an exemplary method (300) for operating a dishwasher appliance in an operation cycle according to exemplary embodiments of the present disclosure. For instance, the method (300) can be used to operate the dishwasher appliance 100 of FIGS. 1 through 3 in an operation cycle. Further, as will be explained below, outputs of temperature sensing device 180 of the dishwasher appliance 100 of FIGS. 1 through 3 can be utilized by controller 160 to make decisions as to which dry cycle mode to select for operating the dry cycle. To provide context to exemplary method (300), the reference numerals used in FIGS. 1 through 3 to describe the features of dishwasher 100 will be used below. It will be appreciated, however, that method (300) is not limited in scope to the dishwasher 100 of FIGS. 1 through 3; rather, method (300) is applicable to other suitable types and models of dishwashers.

At (302), method (300) includes starting or commencing the operation cycle. The operation cycle may include a number of sub cycles. For instance, an exemplary operation cycle may include a wash cycle for washing articles, a rinse cycle to rinse the wash fluid from the articles, a drain cycle to drain the wash fluid from the tub, and a drying cycle to dry the articles. In some operation cycles, one of the sub cycles may be performed or operated more than once. For example, dishwasher appliance 100 may perform a drain cycle after the wash cycle and another drain cycle after the rinse cycle. Other sub cycles not specifically mentioned may also be performed.

The operation cycle may be started or commenced in a number of suitable ways. For instance, a user may manually commence the operation cycle. For example, a user may manipulate one or more input components of user interface panel 164. As another example, a user may activate the operation cycle by utilizing an application on a remote user device communicatively coupled with controller 160 of dishwasher appliance 100. Other suitable manners of commencing the operation cycle are contemplated.

At (304), method (300) includes determining whether the dishwasher appliance has operated a previous operation cycle within a predetermined time of operating the current operation cycle. Stated differently, it is determined whether the dishwasher appliance has operated a previous operation cycle within a predetermined time of commencing the current operation cycle. For instance, controller 160 may determine whether an operation cycle has been performed or operated within a predetermined time of commencing the current operation cycle, e.g., at (302). As one example, the predetermined time is between about six (6) to eight (8) hours. As another example, the predetermined time is a period of time in which the temperature within tub 104 of dishwasher appliance 100 may reach a steady state temperature. That is, the predetermined time may be a period of time that is sufficient for tub 104 to cool down to about the ambient temperature. In some embodiments, the predetermined may be variable and may be set depending on the season and/or the environment in which dishwasher appliance 100 is positioned.

As shown in FIG. 4, on one hand, if dishwasher appliance 100 has not operated a previous operation cycle within the predetermined time of operating or commencing the current operation cycle, then method (300) proceeds to (306). On the other hand, if dishwasher appliance 100 has indeed operated a previous operation cycle within the predetermined time of operating or commencing the current operation cycle, then method (300) proceeds to (308).

At (306), method (300) includes sensing the minimum cycle temperature. For instance, temperature sensing device 180 may sense the minimum cycle temperature. In some implementations, temperature sensing device 180 is a thermistor. Further, in some implementations, temperature sensing device 180 is a thermistor of a turbidity sensor mounted to or positioned proximate sump 138. The minimum cycle temperature is indicative of a minimum temperature within or of tub 104 of dishwasher appliance 100 during an operation cycle. That is, during any of the sub cycles of operation cycle, the minimum cycle temperature is the lowest or minimum temperature within tub 104. In sensing the minimum cycle temperature within dishwasher appliance 100, dishwasher appliance 100 and more particularly controller 160 of dishwasher appliance 100 makes the assumption that the minimum cycle temperature is representative of the ambient air temperature (i.e., the air external to dishwasher appliance 100). As will be explained further below, a dry cycle mode in which to operate dishwasher appliance 100 may be selected based at least in part on the ambient temperature, which is determined by sensing the minimum cycle temperature within tub 104 during an operation cycle.

In some implementations of method (300), to ensure that temperature reading is actually the minimum cycle temperature, as soon as the operation cycle is commenced at (302), the minimum cycle temperature is sensed, e.g., by temperature sensing device 180. That is, the minimum cycle temperature is sensed simultaneously with or nearly simultaneously with the commencement of an operation cycle. In such implementations, by sensing the temperature simultaneously with or nearly simultaneously with the commencement of the operation cycle, water has not yet had a chance to flow into dishwasher appliance 100 to potentially warm the tub 104 and thereby produce an inaccurate representation of the ambient air temperature. As used herein, "nearly simultaneously" means within five (5) seconds of commencing the operation cycle.

In some implementations of method (300), the minimum cycle temperature is sensed at (306) prior to activating the water inlet valve. That is, prior to activating water inlet valve 153 to selectively allow water to flow into dishwasher appliance 100, the minimum cycle temperature is sensed. In such implementations, by sensing the temperature prior to activating the water inlet valve, it may be ensured that the minimum cycle temperature reading is representative of the ambient air temperature as water has not yet flowed into dishwasher appliance 100 to potentially alter the minimum cycle temperature reading from being representative of the ambient air temperature.

In some implementations of method (300), prior to operating the dishwasher appliance in a wash cycle, the minimum cycle temperature is sensed. That is, after an operation cycle is commenced at (302) and prior to commencing the initial wash cycle of the operation cycle, the minimum cycle temperature is sensed, e.g., by temperature sensing device 180. In such implementations, by sensing the temperature prior to operating dishwasher appliance 100 in a wash cycle, it may be ensured that the minimum cycle temperature reading is representative of the ambient air temperature as water has not yet flowed into dishwasher appliance 100 to potentially alter the minimum cycle temperature reading from being representative of the ambient air temperature.

In some implementations of method (300), dishwasher appliance 100 includes one or more spray assemblies 134, 140, 142 and circulation assembly 150 for selectively flowing water to the one or more spray arm assemblies 134, 140, 142. In such implementations, method (300) includes flowing water to the one or more spray arm assemblies. However, in such implementations, the minimum cycle temperature is sensed at (306) prior to flowing water to the one or more spray arm assemblies 134, 140, 142. In such implementations, by sensing the temperature prior to lowing water to the one or more spray arm assemblies 134, 140, 142, it may be ensured that the minimum cycle temperature reading is representative of the ambient air temperature.

At (308), if dishwasher appliance 100 has been operated in a previous operation cycle within the predetermined time of operating or commencing the current operation cycle, method (300) includes retrieving the minimum cycle temperature of the previous operation cycle, e.g., to make decisions regarding the dry cycle mode in which controller 160 should select to operate dishwasher appliance 100 in a dry cycle. Accordingly, at (308) controller 160 retrieves the minimum cycle temperature of the previous operation cycle, e.g., from a memory device of controller 160.

At (310), method (300) includes receiving a temperature signal indicative of a minimum cycle temperature. If method (300) proceeds from (306) to (310), then the temperature signal received at (310) is the sensed minimum cycle temperature at (306). For instance, temperature sensing device 180 may generate one or more signals based on the temperature within tub 104 and such signals indicative of the minimum cycle temperature of the air within tub 104 may be routed to controller 160. Based on the signals received, controller 160 may determine the minimum cycle temperature of the air within tub 104. As noted above at (306), if the temperature sensing device 180 senses the temperature within tub 104 at the appropriate time, the minimum cycle temperature is indicative of the minimum temperature within tub 104 of dishwasher appliance 100 during the operation cycle. If method (300) proceeds from (308) to (310), then the temperature signal received at (310) is the retrieved minimum cycle temperature of the previous operation cycle.

At (312), once the temperature signal is received at (310), method (300) includes determining a dry cycle mode based at least in part on whether the minimum cycle temperature exceeds a temperature threshold. For instance, in some implementations, dishwasher appliance 100 is configured to operate a dry cycle as part of the operation cycle in one of a plurality of dry cycle modes. For instance, one dry cycle mode may be a default or base dry cycle mode and one dry cycle mode may be an adapted dry cycle mode. By way of example, the base dry cycle mode may be the mode in which dishwasher appliance 100 operates the dry cycle if the temperature threshold is not exceeded and the adapted dry cycle mode may the mode in which dishwasher appliance 100 operates the dry cycle if the temperature threshold is exceeded as determined at (312). Thus, by determining whether the minimum cycle temperature exceeds the temperature threshold, controller 160 may select the appropriate dry cycle mode in which to operate the dry cycle.

Figure 5:
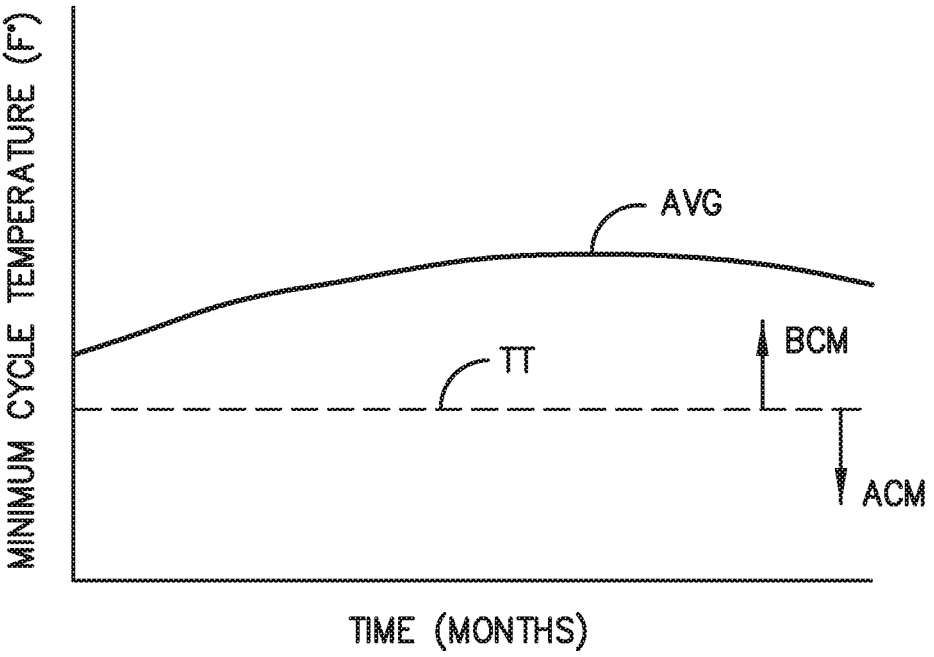
FIG. 5 provides a chart graphically depicting the minimum cycle temperature within a tub of a dishwasher appliance as a function of time according to exemplary embodiments of the present disclosure.

FIG. 5 provides a chart graphically depicting the minimum cycle temperature as a function of time and depicts a temperature threshold TT. The time is represented in months and FIG. 5 depicts a one year cycle extending from January to December. As depicted in FIG. 5, if the minimum cycle temperature received at (310) exceeds or goes beyond the temperature threshold TT, then the adapted cycle mode, denoted as ACM, is selected or determined as the dry cycle mode in which dishwasher appliance 100 operates the dry cycle. If, however, the minimum cycle temperature received at (310) does not exceed or go beyond the temperature threshold TT, then the base cycle mode, denoted as BCM, is selected or determined as the dry cycle mode in which dishwasher appliance 100 operates the dry cycle. In this example, the temperature threshold TT is set as a constant over the year and is set below the average minimum cycle temperature, denoted as AVG. Thus, when the minimum cycle temperature falls below or exceeds the temperature threshold TT, the adapted cycle mode accounts for colder than average temperatures.

Figure 6:
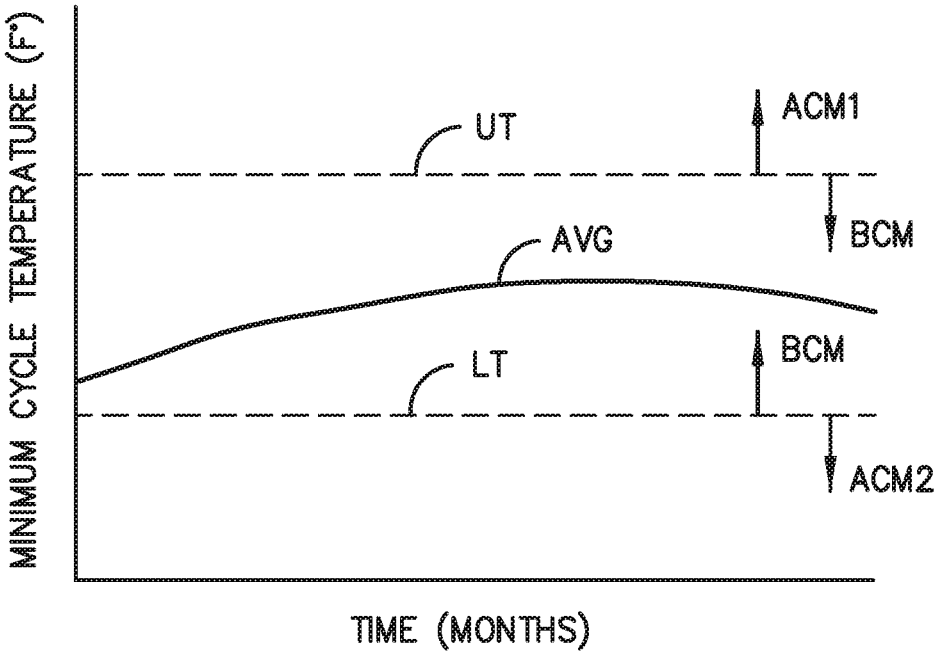
FIG. 6 provides another chart graphically depicting the minimum cycle temperature within a tub of a dishwasher appliance as a function of time according to exemplary embodiments of the present disclosure.

FIG. 6 provides a chart graphically depicting the minimum cycle temperature as a function of time and depicts an upper temperature threshold UT and a lower temperature threshold LT. The time is represented in months and FIG. 5 depicts a one year cycle extending from January to December. As shown in FIG. 6, the upper temperature threshold UT and the lower temperature threshold LT are both fixed. Further, as depicted in FIG. 6, if the minimum cycle temperature received at (310) exceeds or goes beyond the upper temperature threshold UT, then a first adapted cycle mode, denoted as ACM1, is selected or determined as the dry cycle mode in which dishwasher appliance 100 operates the dry cycle. If, however, the minimum cycle temperature received at (310) does not exceed or go beyond the upper temperature threshold UT, then controller 160 checks if the minimum cycle temperature received at (310) exceeds or goes beyond the lower temperature threshold LT. If the minimum cycle temperature received at (310) exceeds or goes beyond the lower temperature threshold LT, then a second adapted cycle mode, denoted as ACM2, is selected or determined as the dry cycle mode in which dishwasher appliance 100 operates the dry cycle. If the minimum cycle temperature received at (310) does not exceed or go beyond the lower temperature threshold LT or the upper temperature threshold UT, then the base cycle mode BCM is selected or determined as the dry cycle mode in which dishwasher appliance 100 operates the dry cycle. In this example, the upper temperature threshold UT is set above the average minimum cycle temperature AVG and the lower temperature threshold LT is set below the average minimum cycle temperature. Thus, when the minimum cycle temperature falls below or exceeds the lower temperature threshold LT, the second adapted cycle mode ACM2 accounts for colder than average temperatures and when the minimum cycle temperature is above or exceeds the upper temperature threshold UT, the first adapted cycle mode ACM1 accounts for warmer than average temperatures.

In some implementations of method (300), the dry cycle modes in which dishwasher appliance 100 may operate the dry cycle may be differentiated by the ratio of moist to dry air in the exhaust stream (or vice versa). For instance, in relatively warmer times of the year, a dry cycle mode that more aggressively removes the moist air from tub 104 may be chosen. That is, the dry cycle mode for warmer times of the year may be chosen such that the exhaust stream has a higher moist to dry air ratio, as the moist air is less likely to condense on a user's floor or cabinetry proximate a user's dishwasher appliance 100. In contrast, in relatively cooler times of the year, a dry cycle mode that less aggressively removes the moist air from tub 104 may be chosen, e.g., so as to prevent pooling or puddles of condensation on a consumer's floor or surrounding cabinetry. That is, the dry cycle mode for relatively cooler times of the year may be chosen such that the exhaust stream has a lower moist to dry air ratio as the moist air is more likely to condense on a user's floor or cabinetry proximate a user's dishwasher appliance 100.

Accordingly, in such implementations, dishwasher appliance 100 includes forced air drying system 190. Forced air drying system 190 includes vent duct 200 that extends between inlet 232 and outlet 252. Inlet 232 is in fluid communication with tub 104 of dishwasher appliance 100. Forced air drying system 190 is configured to move moist airstream MA from tub 104 into vent duct 200. Forced air drying system 190 is also configured to move dry airstream DA into vent duct 200 when dishwasher appliance 100 is operated in the dry cycle, e.g., through inlet 222 of vent duct 200. Further, forced air drying system 190 is configured to exhaust an exhaust stream ES comprised of a mixture of the moist airstream MA and the dry airstream DA through the outlet 252 of vent duct 200 when dishwasher appliance 100 is operated in the dry cycle. In such implementations, the method (300) includes adjusting the mixture of the exhaust stream based at least in part on the dry cycle mode determined.

By way of example, suppose dishwasher appliance 100 is operable and switchable between two (2) dry cycle modes, including a base cycle mode and an adapted cycle mode. Further suppose that the default base cycle has an exhaust stream mixture made up of a moist airstream that is seventy percent (70%) of the total volume of the exhaust stream and a dry airstream that is thirty percent (30%) of the total volume of the exhaust stream. Additionally, suppose that the adapted cycle mode has an exhaust stream mixture made up of a moist airstream that is fifty percent (50%) of the total volume of the exhaust stream and a dry airstream that is fifty percent (50%) of the total volume of the exhaust stream. In this example, suppose that the minimum cycle temperature exceeds the temperature threshold, e.g., as determined at (312). For this example, suppose the minimum cycle temperature is below the temperature threshold and thus exceeds the threshold. Thus, supposing that the minimum cycle temperature has been sensed at the appropriate time that thus the assumption that the sensed minimum cycle temperature is representative of the ambient temperature, controller 160 selects the adapted dry cycle mode. In this way, exhaust stream will have less moist air in its mixture. Accordingly, the exhaust stream will be less likely to condense on a user's floor or surrounding cabinetry. That is, the additional volume of dry air and corresponding less volume of moist air in the exhaust stream will lower the dew point temperature of the exhaust stream, and thus, the air will be less likely to condense when it contacts the surfaces of the surrounding objects.

The mixture of the exhaust stream may be adjusted in a number of suitable ways. For example, in some implementations, one or more fans of the dishwasher appliance 100 may be operated to achieve the desired moist to dry air mixture in the exhaust stream. In alternative implementations, one or more dampers or other actuating components may allow a predetermined volume of ambient air into vent duct 200 to achieve the desired moist to dry air mixture in the exhaust stream.

In some implementations, dishwasher appliance 100 includes forced air drying system 190 that includes vent duct 200, first fan 230, and second fan 220, e.g., as shown in FIG. 3. Vent duct 200 extends between inlets 232, 222 and outlet 252. Inlet 232 is in fluid communication with tub 104 of dishwasher appliance 100. First fan 230 is configured to move moist airstream MA from tub 104 and into vent duct 200, e.g., via pressurizing tub 104. Second fan 220 is configured to move dry airstream DA into vent duct 200 when dishwasher appliance 100 is operated in the dry cycle. Forced air drying system 190 is configured to exhaust or expel exhaust stream ES made up of a mixture of the moist airstream MA and the dry airstream DA through outlet 252 of vent duct 200 when dishwasher appliance 100 is operated in the dry cycle. In such implementations, the method (300) includes setting a fan speed of the first fan to move a predetermined volume of the moist airstream into the vent duct. The method (300) also includes setting a fan speed of the second fan to move a predetermined volume of the dry airstream into the vent duct. In such implementations, the fan speed of the first fan and the fan speed of the second fan are set based at least in part on the dry cycle mode determined.

By way of example, continuing with the example above, in the base dry cycle mode, the fan speed of the first fan 230 and the fan speed of the second fan 220 may be set such that the moist to dry air mixture of the exhaust stream ES is seventy percent (70%) moist air and thirty percent (30%) dry air. In comparison, in the adapted cycle mode, the fan speed of the first fan 230 and the fan speed of the second fan 220 may be set such that the moist to dry air mixture of the exhaust stream ES is fifty percent (50%) moist air and fifty percent (50%) dry air. As such, the adapted dry cycle mode removes moist air less aggressively from tub 104 but facilitates condensation abatement on a consumer's floor, surrounding cabinetry, and/or other objects.

At (314), method (300) includes operating the dishwasher appliance in a dry cycle in the dry cycle mode determined. For instance, after operating dishwasher appliance 100 in one or more wash cycles, one or more rinse cycles, one or more drain cycles, dishwasher appliance 100 is operated in a dry cycle, e.g., to dry the articles within dishwasher appliance 100. In particular, dishwasher appliance 100 is operated in a dry cycle in the dry cycle mode determined at (312).

During or after operating dishwasher appliance 100 in the dry cycle, the minimum cycle temperature used by controller 160 to make decisions as to the dry cycle mode in which to operate dishwasher appliance 100 is stored, e.g., in one or more memory devices of controller 160. In this way, the minimum cycle temperature may potentially be used in a subsequent operation cycle of dishwasher appliance 100, e.g., if dishwasher appliance 100 is operated within a predetermined time of operating the current operation cycle as determined at (304).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance configured to perform an operation cycle, the dishwasher appliance comprising:
- a cabinet;
- a tub positioned within the cabinet and defining a wash chamber for receipt of articles for washing;
- a temperature sensing device configured to sense a temperature within or of the tub;
- a controller communicatively coupled with the temperature sensing device, the controller configured to:
  - receive a temperature signal from the temperature sensing device, the temperature signal being indicative of a minimum cycle temperature indicative of a minimum temperature within or of the tub during the operation cycle;
  - initiate a wash cycle of the dishwasher appliance;
  - determine whether the minimum cycle temperature exceeds one or more temperature thresholds;
  - determine a dry cycle mode based at least in part on whether the minimum cycle temperature exceeds the one or more temperature thresholds; and
  - operate the dishwasher appliance in a dry cycle in the dry cycle mode determined, wherein the temperature signal is received before the wash cycle is initiated.

2. The dishwasher appliance of claim 1, further comprising:
- one or more spray arm assemblies;
- a circulation assembly for selectively flowing water to the one or more spray arm assemblies;
- wherein, to operate the dishwasher appliance in the wash cycle, the controller is further configured to:
  - activate the circulation assembly to flow water to the one or more spray arm assemblies, and wherein the temperature signal received by the controller is sensed by the temperature sensing device prior to the controller activating the circulation assembly.

3. The dishwasher appliance of claim 1, further comprising:
- a sump in fluid communication with the tub, and wherein the temperature sensing device is mounted to or positioned within the sump.

4. The dishwasher appliance of claim 1, wherein the temperature sensing device is a thermistor that is a component of a turbidity sensor.

5. The dishwasher appliance of claim 1, further comprising a forced air drying system, the forced air drying system comprising:
- a first fan;
- a second fan; and
- a vent duct defining a first inlet, a second inlet, and an outlet, the first inlet in fluid communication with the tub, the first fan configured to move a moist airstream from the tub into the vent duct through the first inlet and the second fan configured to move a dry airstream into the vent duct through the second inlet to mix with the moist airstream, and wherein the controller is further configured to:
  - set a fan speed of the first fan and a fan speed of the second fan based at least in part on the dry cycle mode determined.

6. The dishwasher appliance of claim 5, further comprising:

a door rotatably coupled with the cabinet, wherein at least a part of the forced air drying system is positioned within the door.

7. The dishwasher appliance of claim 1, further comprising a forced air drying system, the forced air drying system comprising:

a vent duct mounted to a sidewall of the tub and defining a first inlet, a second inlet, and an outlet, the first inlet in fluid communication with the tub;

a first fan mounted to the sidewall of the tub and configured to move a moist airstream from the tub into the vent duct through the first inlet;

a second fan mounted within the vent duct and configured to move a dry airstream into the vent duct through the second inlet to mix with the moist airstream;

wherein the controller is further configured to:

set a fan speed of the first fan and a fan speed of the second fan based at least in part on the dry cycle mode determined.

8. A method for operating a dishwasher appliance in an operation cycle, the dishwasher appliance comprising a cabinet, a tub positioned within the cabinet and defining a wash chamber for receipt of articles for washing, a temperature sensing device configured to sense a temperature within or of the tub, and a controller communicatively coupled with the temperature sensing device, the method comprising:

receiving a temperature signal indicative of a minimum cycle temperature, the minimum cycle temperature indicative of a minimum temperature within the tub of the dishwasher appliance during the operation cycle;

initiating a wash cycle of the dishwasher appliance;

determining whether the minimum cycle temperature exceeds a temperature threshold;

determining a dry cycle mode based at least in part on whether the minimum cycle temperature exceeds the temperature threshold; and operating the dishwasher appliance in a dry cycle in the dry cycle mode determined, wherein the temperature signal is received before the wash cycle is initiated.

9. The method of claim 8, further comprising:

operating the dishwasher appliance in the wash cycle;

sensing the minimum cycle temperature, wherein the minimum cycle temperature is sensed prior to operating the dishwasher appliance in the wash cycle.

10. The method of claim 9, wherein the minimum cycle temperature is sensed by the temperature sensing device positioned at or proximate a sump of the dishwasher appliance.

11. The method of claim 10, wherein the temperature sensing device is a thermistor of a turbidity sensor.

12. The method of claim 8, further comprising:

operating the dishwasher appliance in a drain cycle, wherein the dishwasher appliance is operated in the drain cycle prior to operating the dishwasher appliance in the dry cycle.

13. The method of claim 8, wherein the dishwasher appliance comprises one or more spray arm assemblies and a circulation assembly for selectively flowing water to the one or more spray arm assemblies, and wherein the method further comprises:

flowing water to the one or more spray arm assemblies; and sensing the minimum cycle temperature, wherein the minimum cycle temperature is sensed prior to flowing water to the one or more spray arm assemblies.

14. The method of claim 8, wherein the dishwasher appliance comprises a water inlet valve for selectively allowing water to flow into the dishwasher appliance, and wherein the method further comprises:

activating the water inlet valve to selectively allow water to flow into the dishwasher appliance; and sensing the minimum cycle temperature, wherein the minimum cycle temperature is sensed prior to activating the water inlet valve.

15. The method of claim 8, wherein the dishwasher appliance comprises a forced air drying system comprising a vent duct extending between an inlet and an outlet, the inlet in fluid communication with the tub of the dishwasher appliance, wherein the forced air drying system is configured to move a moist airstream from the tub into the vent duct and the forced air drying system is configured to move a dry airstream into the vent duct when the dishwasher appliance is operated in the dry cycle, and wherein the forced air drying system is configured to exhaust an exhaust stream comprised of a mixture of the moist airstream and the dry airstream through the outlet when the dishwasher appliance is operated in the dry cycle, and wherein the method further comprises:

adjusting the mixture of the exhaust stream based at least in part on the dry cycle mode determined.

16. The method of claim 8, wherein the dishwasher appliance comprises a forced air drying system comprising a vent duct, a first fan, and a second fan, the vent duct extending between an inlet and an outlet, the inlet in fluid communication with the tub of the dishwasher appliance, the first fan configured to move a moist airstream from the tub and into the vent duct and the second fan configured to move a dry airstream into the vent duct when the dishwasher appliance is operated in the dry cycle, and wherein the forced air drying system is configured to exhaust an exhaust stream comprised of a mixture of the moist airstream and the dry airstream through the outlet of the vent duct when the dishwasher appliance is operated in the dry cycle, and wherein the method further comprises:

setting a fan speed of the first fan to move a predetermined volume of the moist airstream into the vent duct; and setting a fan speed of the second fan to move a predetermined volume of the dry airstream into the vent duct;

wherein the fan speed of the first fan and the fan speed of the second fan are set based at least in part on the dry cycle mode determined.

* * * * *